US008036405B2

(12) United States Patent
Ludvigsen et al.

(10) Patent No.: US 8,036,405 B2
(45) Date of Patent: Oct. 11, 2011

(54) HEARING AID SYSTEM, A HEARING AID AND A METHOD FOR PROCESSING AUDIO SIGNALS

(75) Inventors: Carl Ludvigsen, Valby (DK); Andre Marcoux, Ottawa (CA)

(73) Assignee: Widex A/S, Varlose (DK)

( * ) Notice: Subject to any disclaimer, the term of this patent is extended or adjusted under 35 U.S.C. 154(b) by 1211 days.

(21) Appl. No.: 11/268,620

(22) Filed: Nov. 8, 2005

(65) Prior Publication Data

US 2006/0093172 A1 May 4, 2006

Related U.S. Application Data

(63) Continuation-in-part of application No. PCT/DK03/00309, filed on May 9, 2003.

(51) Int. Cl.
*H04R 25/00* (2006.01)

(52) U.S. Cl. ..... 381/317; 381/312; 381/315

(58) Field of Classification Search ..... 381/312–331
See application file for complete search history.

(56) References Cited

U.S. PATENT DOCUMENTS

| | | | | |
|---|---|---|---|---|
| 4,611,598 | A | 9/1986 | Kunick | |
| 5,615,229 | A | 3/1997 | Sharma et al. | |
| 5,734,976 | A | 3/1998 | Bartschi et al. | |
| 6,307,945 | B1 | 10/2001 | Hall | |
| 6,516,075 | B1 | 2/2003 | Jacobs et al. | |
| 6,882,736 | B2 * | 4/2005 | Dickel et al. | 381/317 |
| 7,020,296 | B2 * | 3/2006 | Niederdrank | 381/315 |
| 2002/0106094 | A1 | 8/2002 | Fujino | |

FOREIGN PATENT DOCUMENTS

| | | | |
|---|---|---|---|
| CN | 1290114 | * | 4/2001 |
| CN | 1290114 | A | 4/2001 |
| DE | 30 32 311 | A1 | 8/1980 |
| GB | 2 234 882 | A | 2/1991 |
| JP | 2001-309498 | A | 11/2001 |
| WO | WO 01/67433 | A1 | 9/2001 |

OTHER PUBLICATIONS

Nilsson, Michael J. and Bray, Jr., Victor H.; The Noise Reduction Index: Benchtop Estimate of SNR Changes; Aug. 25-29, 2004; Sonic Innovations; vol. 7 No. 1/2004.*

* cited by examiner

*Primary Examiner* — Davetta Goins
*Assistant Examiner* — Matthew Eason
(74) *Attorney, Agent, or Firm* — Sughrue Mion, PLLC

(57) ABSTRACT

A composite hearing aid system comprises two hearing aids (11, 31) with respective microphones (12, 32) and electronic receivers (17, 37), a microphone (42) and a transmitter (41) adapted to transmit the signal from the microphone (42) to the electronic receivers. At least one of the hearing aids (11, 31) comprises means for inverting the phase of the signal received by the electronic receivers (17, 37). When the phase of the received signal is inverted in one of the hearing aids (11, 31), a release from masking is obtained, and the perceived signal-to-noise ratio is improved. The invention provides a composite hearing aid system, a hearing aid and a method for processing audio signals.

15 Claims, 5 Drawing Sheets

HEARING AID SYSTEM, A HEARING AID AND A METHOD FOR PROCESSING AUDIO SIGNALS

RELATED APPLICATIONS

The present application is a continuation-in-part of application No. PCT/DK2003/000309, filed on 09 May 2003 in Denmark, and published as WO 2004/100607 A1.

BACKGROUND OF THE INVENTION

1. Field of the Invention

The present invention relates to hearing aids. The invention further relates to hearing aid systems and to a method for processing audio signals. More specifically the invention relates to hearing aid systems capable of processing signals from more than one type of signal source, such as a microphone in combination with any one of a radio wave receiver, an audio-input device, a telecoil receiver, an optical receiver (e.g. infrared) and the like. The invention, in a further aspect, relates to a method for enhancing the signal-to-noise ratio (SNR) in a composite hearing aid system.

2. The Prior Art

Hearing aids having more than one input are well known. Hearing aids having inputs for different types of signals, herein designated composite hearing aids, also exist. Particularly well known examples comprise hearing aids with a microphone input and with a telecoil input. DE-A-3032311 discloses a radio receiver accessory adapted for plug-in connection to a hearing aid in order to provide a radio reception capability. The receiver is powered by the hearing aid battery. U.S. Pat. No. 5,734,976 discloses a miniature radio receiver adapted for connection to a hearing aid fitted with an additional loop antenna. A switch permits changing the balance between microphone input and radio input.

U.S. Pat. No. 6,307,945 provides a personal hearing aid system. The hearing aid system interfaces with existing hearing aids using the "T" facility (i.e. a telecoil capability). The system comprises a microphone, an FM radio transmitter connected to the microphone, a receiver unit for receiving a signal from the transmitter unit, and a hearing aid with a "T" facility. The receiver unit connects to an induction loop, and the hearing aid receives the signal from the induction loop and transmits an audio signal.

U.S. Pat. No. 6,516,075 shows a hearing enhancement system for co-operation with a conventional hearing aid used in "T"-switch mode, including a microphone and an induction loop. The induction loop is worn around the body of a speaking person. The induction loop generates an electromagnetic signal that may propagate some distance away from the speaking person to be picked up by a telecoil-enabled hearing aid.

U.S. Pat. No. 5,615,229 provides a short range wireless communications system employing a belt worn receiver coupled via a cord or cable to a loop which is worn under the clothing of the hearing aid user. The hearing aid in turn has an inductive pick up coil for picking up the loop signal. The receiver may include RF receiver circuitry to pick up and convert an RF signal to an audio frequency electrical signal.

In a composite system, the transmitter is typically positioned near a distant sound source that is of interest to the hearing-impaired individual. The delivery of information from the transmitter to the receiver, connected to the hearing-impaired individual's hearing aid, will thus permit the audibility of the distant sound sources. The main use for a composite hearing aid system is in situations where the preferred acoustic source, e.g. an orator, has a remote, but well known, location and where additional use of the hearing aid microphones is advantageous. For the hearing-impaired, these situations include educational settings, meetings, public presentations, church sermons and the like. In these situations a wireless receiver is beneficial in order to achieve an appropriate S/N ratio and an increased speech intelligibility for the hearing aid user.

Nevertheless, using a wireless receiver with a hearing aid without using the hearing aid microphones also exposes some inherent problems in use. One problem is the reduced ability to pick up wanted sounds other than those being fed directly into the transmitter, e.g. comments from parts of the audience outside the range of the transmitter microphone. This can impair the ability to participate in, for instance, an educational setting, as the inclination to ask any questions is modest if one cannot hear his or her own voice.

The hearing aid user may have a wireless receiver for both hearing aids (left and right) or for just one of them. When using wireless receivers on both hearing aids, the signals reproduced by the two receivers can be presumed to be identical and mutually in phase, i.e. they are perceived as a diotic signal.

In research dealing with determining perception of signals in noise, both the noise source and the desired signal source are often controlled to a great extent. The noise level and the balance between the noise and the desired signal determine the conditions under which experiments are carried out. The noise source usually masks the signal in some way, and is therefore denoted a masker. Different properties like intelligibility or hearing threshold level may be examined during such experiments, including binaural conditions.

A diotic signal may be a stimulus presented in the same way to both ears, $M_0S_0$, where M denotes a masker and S denotes a desired signal of the combined stimulus. This condition should be distinguished from the monotic condition, $M_mS_m$, a stimulus presented to one ear only, and from the dichotic condition, where the stimulus is presented differently to the two ears, e.g. $M_0S_\pi$, $M_0S_m$, $M_\pi S_0$, etc. This is explained in further detail in the following, where S denotes the signal and M denotes the masker.

If a signal is presented binaurally in a homophasic condition (the same signal is presented in an identical form to both ears), this signal can be denoted $S_0$, where the suffix 0 indicates the lack of phase difference between the signals presented to both ears. Likewise, a signal presented 180° out of phase to one ear when compared to the other ear can be denoted $S_\pi$, where the suffix $\pi$ denotes the antiphasic relationship between the two signals.

In the dichotic conditions, one of the two stimuli (i.e. the tone) is presented differently to the two ears, binaurally (e.g. $S_\pi S_0$, where the speech is presented in phase binaurally while the masker is presented 180° out-of-phase binaurally).

A well-known method for improving perceived SNR exploits a psychoacoustic phenomenon known as the binaural masking level difference (BMLD). Listening tests have revealed that a difference in masking level can improve the ability to detect a tone presented to the listener in competing noise. The BMLD is evaluated where tones are presented to both ears at the same time that a masking or competing noise is being delivered binaurally (Licklider, 1948). See table 1. The listener is tested under two conditions, a homophasic and an antiphasic condition. In the homophasic condition the speech or tones are presented either monotic to one ear, $M_mS_m$, or diotic to both ears in phase, $M_0S_0$.

TABLE 1

| Interaural condition compared to $M_mS_m$ | | MLD (masking level difference) |
|---|---|---|
| Monotic, diotic | $M_mS_m$, $M_0S_0$ | 0 dB |
| Dichotic | $M_\pi S_m$ | 6 dB |
| Dichotic | $M_0S_m$ | 9 dB |
| Dichotic | $M_\pi S_0$ | 13 dB |
| Dichotic | $M_0S_\pi$ | 15 dB |

When the signal and masker are presented in this antiphasic fashion, a maximal release from masking is obtained, i.e. the listener is able to comprehend a tone level that would otherwise have been buried by the masker. The difference in thresholds between the homophasic and antiphasic condition reveals the BMLD. Green and Yost (Handbook of Sensory Psychology, Springer-Verlag, 1975, pp 461-465) have demonstrated a BMLD effect of up to 15 dB in a population of normal listeners (Table 1). The BMLD, as shown in table 1, is limited to deal with detection of pure tones in unmodulated broadband noise only, but are incorporated to explain the principles behind the invention.

Currently, the masking level difference may be observed in systems where only one of two hearing aids is equipped with a wireless receiver, and where the HA microphones are active, "ON", corresponding to the dichotic condition $M_0S_m$, thus giving a theoretical benefit of 9 dB if pure tones are used for the signal.

Green and Yost verified these values with white noise with a spectrum density level of 60 dB as the masker and a low-frequency sinusoid, e.g. 500 Hz, presented intermittently to the listener at brief durations of approximately 10-100 ms, as the signal. The conclusions drawn from the experiments are that the BMLD is never negative, but, for some binaural conditions, may be zero dB, i.e. no improvement.

A more practical approach may be taken by applying a different type of measurement, known as the binaural intelligibility level difference, or BILD. This test is based on the fact that the recognition of speech can be measured by presenting nonsense, one-syllable words, denoted logatomes, to a listener at varying sound pressure levels to determine the degree of syllabic recognition. This is measured as the percentage of syllables in a spoken sentence that are perceived correctly. The syllabic intelligibility level is defined as the sound pressure level of speech in connection with which a given degree, say, 50%, of syllabic intelligibility is attained. (Blauert et. al., Spatial Hearing, The MIT Press, 1974.)

In a real-life situation, even a modest improvement in SNR from a BMLD or a BILD may provide a major enhancement of the intelligibility of speech in noisy conditions. See table 2. One example of a situation where speech and masking noise are present is that of an educational setting. In this situation, the teacher is positioned in the front end of the room and there may be instances of noise from other students or from the environment that make it difficult, especially for hearing-impaired individuals, to hear what is being said by the teacher. For hearing-impaired listeners, the use of a composite system is often preferred in these situations in order to permit the delivery of acoustic characteristics of distant sound sources, such as the teacher's voice, to the ear.

TABLE 2

| Interfering noise | BILD, $M_\pi S_0$ |
|---|---|
| White noise, 75 dB | 7.2 dB |
| Modulated white noise $f_m$ = 4 Hz, m = 62% | 5.5 dB |
| 1 speaking voice | 4.3 dB |

TABLE 2-continued

| Interfering noise | BILD, $M_\pi S_0$ |
|---|---|
| 1 speaking voice + white noise | 5.7 dB |
| 1 speaking voice + modulated white noise | 5.2 dB |
| 2 speaking voices | 9.0 dB |
| 2 speaking voices + white noise | 6.4 dB |
| 2 speaking voices + modulated white noise | 6.6 dB |

The use of a composite system will thus improve the perceived SNR and facilitate the comprehension of the teacher's voice. However, in order for the hearing-impaired individual to monitor his/her own voice and the immediate acoustic environment, the hearing aid microphones are usually activated in the composite system together with the transmitter microphone, and this combination has a negative influence on the S/N ratio when compared to the wireless receiver on its own.

However, a moderate release from masking may be obtained in a composite system where the hearing aid microphones are activated, but where a wireless receiver is connected to only one of the two hearing aids. This corresponds to the $M_0S_m$ condition in table 1. This approach combines the advantages of a desirable SNR and monitoring of one's own voice. Also, this approach in providing composite systems is common practice by practising audiologists today, partly due to economical considerations.

SUMMARY OF THE INVENTION

The invention provides a hearing aid system comprising a first hearing aid having a first microphone, a first acoustic output transducer, a first electronic receiver and a first processor, said first processor being adapted to process an output signal from the first microphone and an output signal from the first electronic receiver in order to output through the first output transducer an acoustic signal for a user's right ear, a second hearing aid having a second microphone, a second acoustic output transducer, a second electronic receiver and a second processor, said second processor being adapted to process an output signal from the second microphone and an output signal from the second electronic receiver in order to output through the second output transducer an acoustic signal for a user's left ear, an electronic transmitter system adapted to transmit a signal for being received by the first and second electronic receivers, and means for inverting the phase of the signal received by one of the first or second electronic receivers as compared to the phase of the other one of the first or second electronic receivers.

The term "inverting the phase" should be considered the equivalent of a reversal of polarity of the signal, as it will be understood by a person skilled in the art. An inversion of the phase characteristics can also be made otherwise, for instance by changing the phase of the signal by 180° by means of suitable electronic circuitry. In all instances, the phase reversal can be thought of as a curve representing the signal and mirrored in the time axis.

The system according to the invention provides a composite hearing aid system with an enhanced, perceived signal-to-noise ratio. The system has been tried in field tests where a significant improvement has been observed. The improvement is ascribed to a release from masking due to the phase reversal in one of the electronic receivers.

The microphone may be any acoustic hearing aid input transducer known in the field, e.g. a hearing aid microphone, an array of microphones etc. The means for offsetting the phase characteristics may comprise means for inverting the polarity of the signal, means for temporal offset of the signal or means for similar processing. The electronic receiver may comprise any electronic device capable of receiving a signal, e.g. a cable, a telecoil antenna, a radio receiver, an optical receiver or other receiver means.

By allowing the phase of the signal from one of the electronic receivers to be inverted in one of the hearing aids according to the invention, an improvement in SNR performance of at least 4-5 dB, in some cases up to about 8-9 dB, can be achieved over and above what is provided by a composite system in an $M_0S_m$ configuration, according to the prior art.

According to an embodiment, the hearing aid system comprises switching means for manually activating the inversion of the phase of the signal of a respective one of the electronic receivers.

This arrangement allows for the phase of the signal from one of the electronic receivers in one among a pair of hearing aids to be selectively set in an in-phase or an out-of-phase position during fitting, thus allowing the SNR performance enhancement to be activated by the fitter of the hearing aid.

The electronic receiver of the composite hearing aid system, i.e. the secondary audio input, can be used in combination with the hearing aid microphone, according to the invention, or it can be used alone. It is a part of fitting procedure to fit the hearing aid to the hearing loss of the hearing-impaired user in order to ensure balance of loudness of the perceived response of the primary audio input and the secondary audio input. Measurements required prior to fitting the secondary input to a particular hearing aid may involve coupler measurements, i.e. measurements of the acoustic reproduction system of the hearing aid including the acoustic transducer and the tube or plug fitted to the ear of the user.

The invention, in a further aspect, provides a hearing aid comprising a microphone, an acoustic output transducer, a processor, and means for interfacing with an electronic receiver, said processor being adapted to process an output signal from the microphone and an output signal from the electronic receiver, said means for interfacing with the electronic receiver having means for inverting the phase of the output signal from the electronic receiver.

The means for inverting the phase of the signal from the electronic receiver may be enabled by a switch on the hearing aid, by a command from a programming box for programming the hearing aid, or by remote control.

This hearing aid, when used in combination with a similar hearing aid wherein the means for inverting the phase has been disabled, will achieve an enhanced, perceived SNR ratio due to the release from masking. The same will be achieved when using the hearing aid in a combination with a non-inverting hearing aid.

According to an embodiment, the hearing aid comprises means for analysing and detecting presence of speech and noise in the input signal and activating inversion of the phase in the electronic receiver if the detected noise level exceeds a predetermined limit when compared to the detected speech level.

This feature of the invention makes it possible for the hearing aid circuitry to invert the phase in one of two hearing aids selectively and automatically, and thus providing a release from masking whenever this might be of benefit to the user.

The invention, in a still further aspect, provides a method for processing an audio signal derived from a pair of audio sources associated with a pair of hearing aids, comprising inverting the phase of the output signal of one of the audio sources as compared to the phase of the output signal of the other one of the audio sources.

The audio source pair may be any combination of one or more hearing aid microphones, a pair of electronic receivers, a pair of telecoils, or a pair of direct audio input leads. In this way, a release from masking may be attained independent of the source or sources of the signal to be reproduced by the composite hearing aid system.

Ambient noise presents a problem to the listener in situations where the overall noise level is dominated by the amplification of the ambient noise at the hearing aid microphone, thus reducing the SNR advantage of the composite system. The problem is, to some extent, alleviated by increasing the sensitivity of the electronic receiver. However, the invention provides a more efficient solution as explained in the detailed part of the specification.

According to an embodiment, the method comprises selecting for the first audio source pair the one among the audio source pairs with the highest signal-to-noise ratio. This selection may, in a further aspect of the invention, be implemented by the means for inverting the phase of the output signal from the audio source in the particular audio source pair where the signal-to-noise ratio is highest, thus producing a release from masking in the output signal where the user will get the biggest benefit from a release from masking.

The invention will thus improve speech intelligibility in typical situations, where the orator is at a distance from the listener and one or more noise sources are in proximity to the listener, for instance in an educational situation, where a teacher wearing a transmitter microphone is addressing students in a classroom, and where communication between the students is encouraged. Both the signal from the hearing aid microphones and the signal from the electronic receivers have important functions here. The electronic receivers aid the hearing-impaired student in hearing what the teacher is saying, and the hearing aid microphones help in reproducing the hearing aid user's own voice, as well as picking up what other students are saying, for instance, addressing the teacher with questions during the lesson or, if they are in a cooperative group, working together solving a particular problem.

The use of two different input systems, as is the case in a composite system, will permit the BILD to be observed. A transmitter microphone located near a distant source of interest will be dominated by speech. Furthermore, the hearing aid microphones will be dominated by noise in the vicinity of, or behind, the hearing-impaired listener. If the signal of interest is presented to the hearing-impaired listener in a dichotic, antiphasic condition and the noise is presented in a diotic, homophasic condition, a release from masking by the competing noise will result, and a corresponding improvement in SNR may be obtained.

Further embodiments and features will appear from the independent claims.

BRIEF DESCRIPTION OF THE DRAWINGS

The invention will now be described in greater detail with reference to the drawings, where.

DETAILED DESCRIPTION OF THE INVENTION

Figure 1:
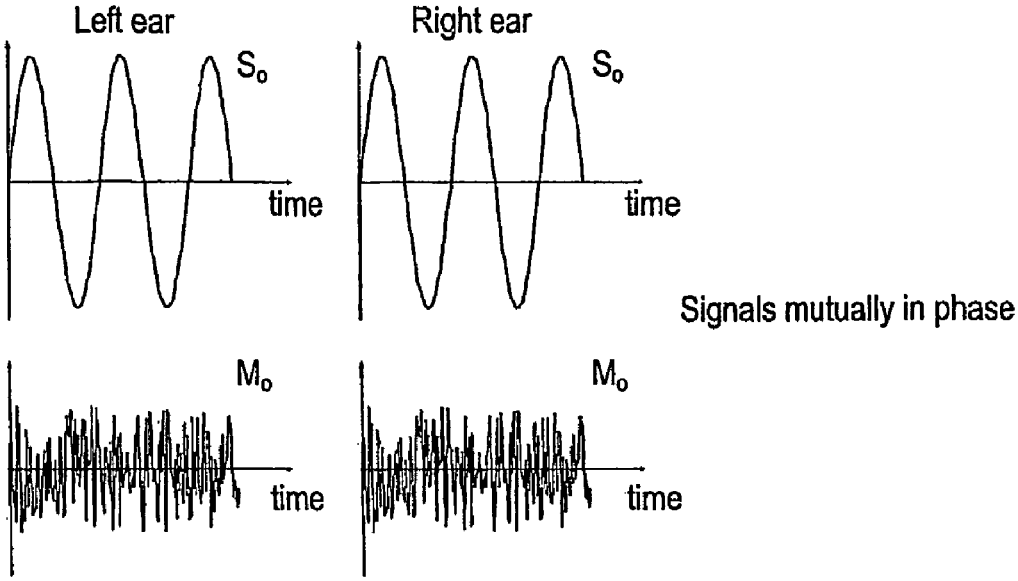
FIG. 1 shows an example of a signal and a masker in two hearing aids with the signals mutually in phase.
Figure 2:
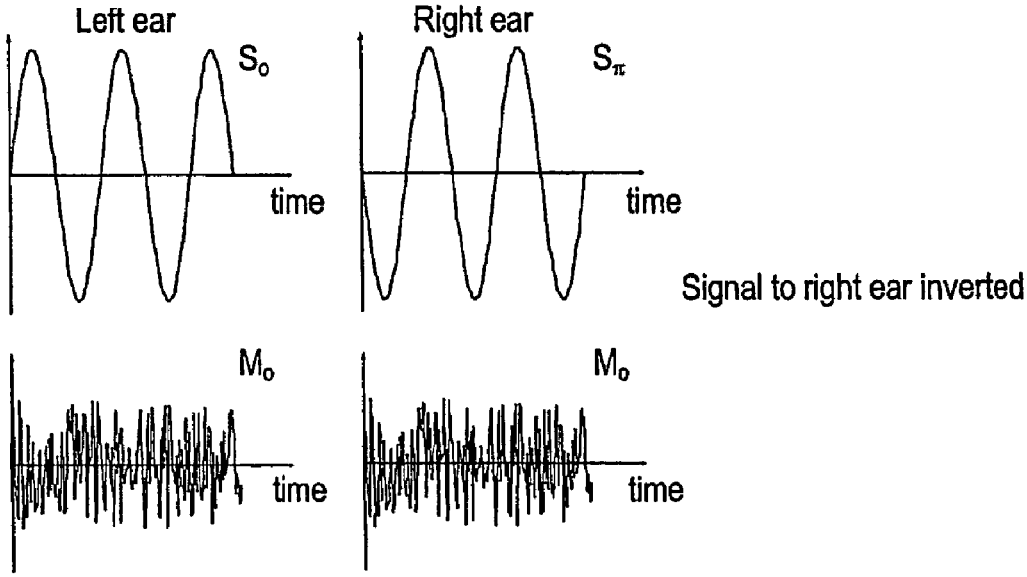
FIG. 2 is the example similar to FIG. 1, but with the signals mutually 180° out of phase.

The relationship between signal and masker under binaural listening conditions is illustrated in FIGS. 1 and 2. FIG. 1 shows a signal $S_0$ and a masker $M_0$ presented to the right and left ears of a listener in the case where both the signals $S_0$ and the masker $M_0$ are mutually in phase in the two audio channels, $M_0S_0$.

In FIG. 2, both the signal and the masker are presented to the right and left ears of a listener in the case where the right signal is 180° out-of-phase with the left signal, and the masker is still in phase in both channels, $S_\pi M_0$. The result of this phase reversal is a release from masking of the signal presented to the listener, and an additional perceived improvement of up to 4-5 dB SNR.

Figure 3:
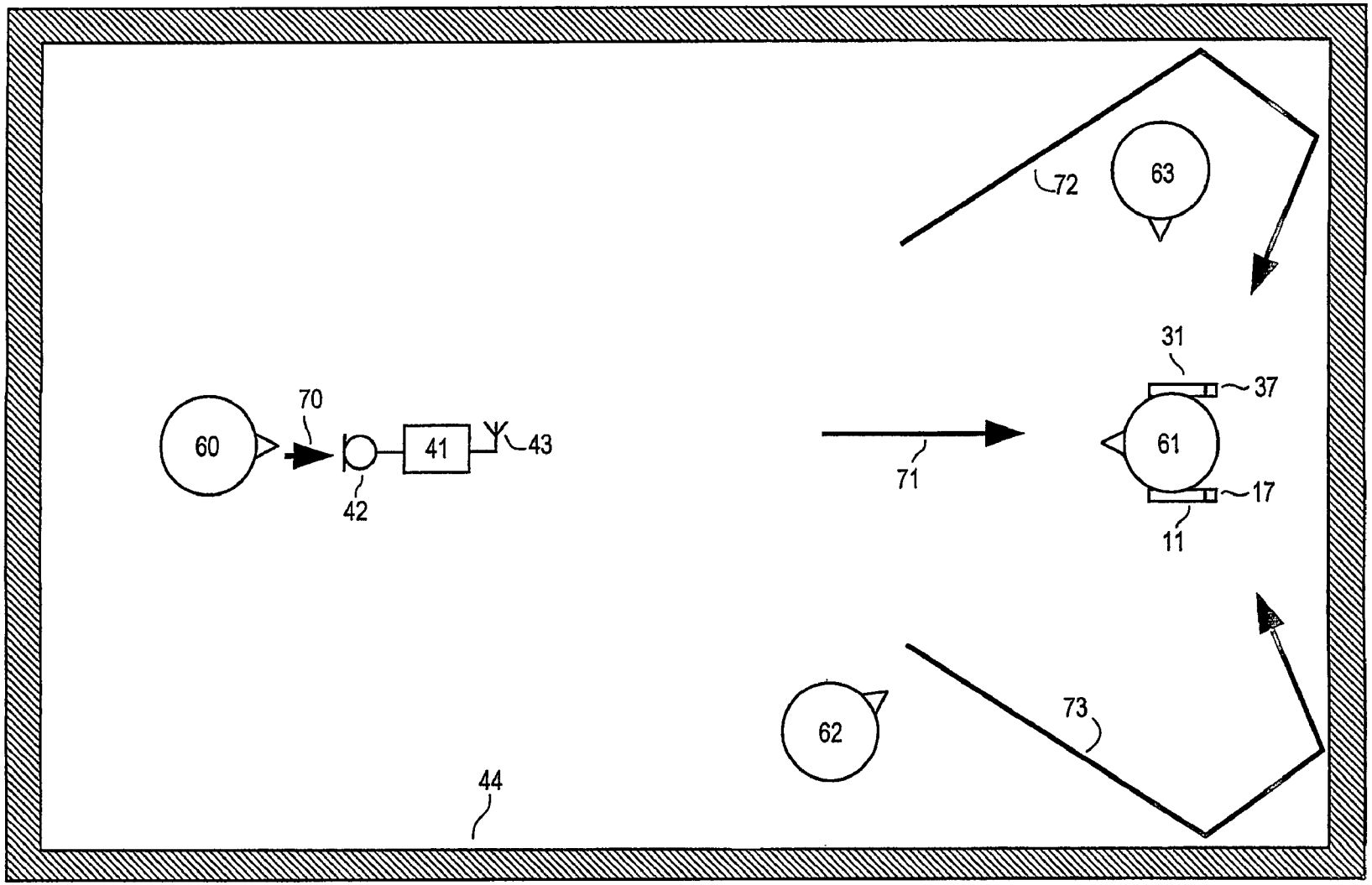
FIG. 3 is a schematic view of a typical user situation where a hearing aid user can benefit from the invention.

A practical user situation is shown in FIG. 3, where a user 61 situated in a room 44 is wearing binaural hearing aids 11, 31 with wireless electronic receivers 17, 37. In the same room 44 an orator 60 situated some distance away from the user 61 is speaking into a microphone 42 connected to a transmitter 41 and an antenna 43 transmitting a radio signal representing the signal from the microphone 42. From the orator 60, a direct part of the sound propagates along a path 70 to the microphone 42. Other parts of the sound propagates along paths 72 and 73, bounces off the walls of the room 44 and reach the user 61 from the rear. Still other parts of the sound propagate along the path 71, reaching the user 61 directly. The parts of the sound travelling along the paths 71, 72, and 73 are picked up by the microphones in the hearing aids 11, 31, and the resulting signals amplified by the hearing aids. The signal from the transmitter 41 is picked up by both the electronic receivers 17, 37 and directed to the hearing aids, each of the hearing aids mixing the received signals with the signals from the respective hearing aid microphones.

Apart from the direct sound part propagating along the direct path 71 and the indirect sound part propagating along the paths 72 and 73, two additional sound sources in the form of orators 62, 63 add to the total sound environment presented to the user 61 by the hearing aids 11, 31. In case the user 61 wants to hear his or her own voice properly, or hear other speakers in the room, the microphones in the hearing aids 11, 31 have to be left on when using the composite system, although this is likely to introduce less wanted sound sources in the form of room reflections and probably other occupants of the same room 44.

To alleviate the poorer signal-to-noise ratio in this situation, the phase of the signal from one of the wireless receivers 17, 37 may be inverted according to the invention, resulting in a release from masking as previously explained. The actual inversion of the signal may be performed in one of the electronic receivers 17, 37, in an interfacing device (not shown) suitable for connecting the receivers 17, 37 to the hearing aids 11, 31, or in the signal processing circuitry of one of the hearing aids 11, 31.

This inversion results in the signals from the wireless electronic receivers 17, 37 being delivered in a dichotic, antiphasic fashion, while the signals from the microphones of the hearing aids 11, 31 being delivered in a dichotic, homophasic fashion and the resulting perceived difference between the signals from the two different sets of signal sources represents the BILD of the composite system utilizing the invention. Typical improvements of from 5 and up to 9 dB are attainable by the invention.

Figure 4:
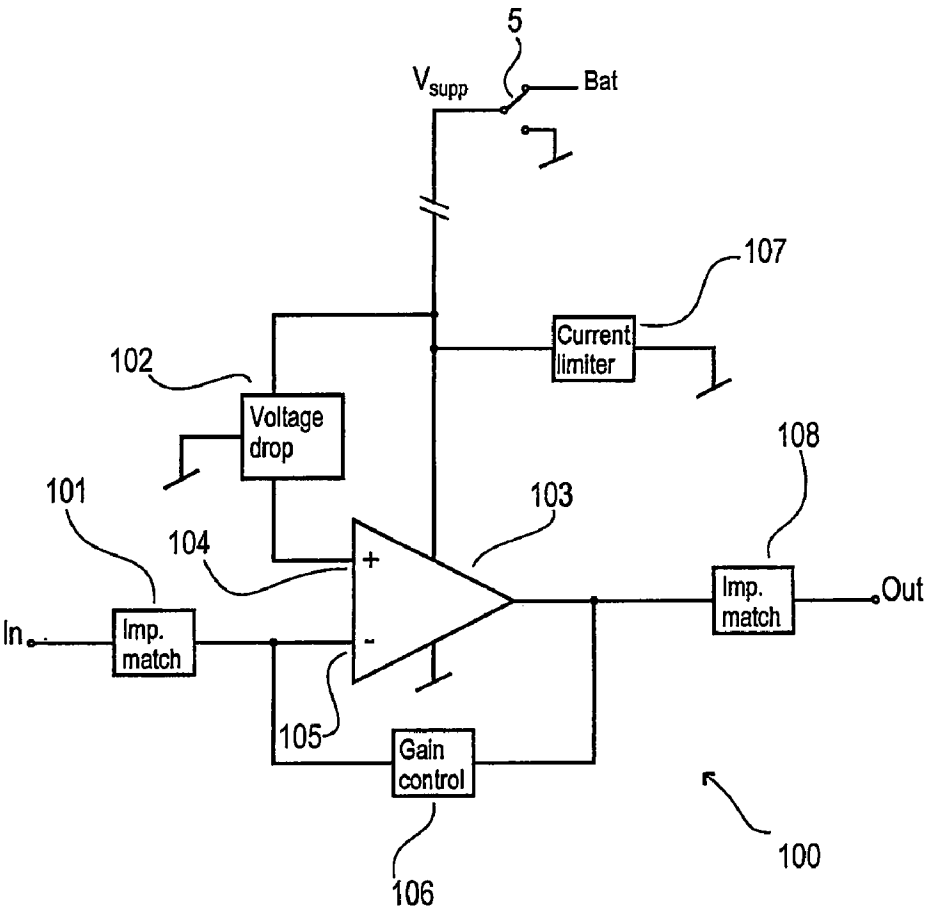
FIG. 4 is a block schematic of a preferred embodiment of the inverter stage in the hearing aid according to the invention.

FIG. 4 shows a practical implementation of an inverter stage 100 suitable for use with the invention. The input terminal In is connected to an inverting input 105 of an amplifier 103 via an input impedance matching network 101. The operating point of the amplifier 103 is determined by a voltage drop network, preferably embodied as a voltage divider network 102, connected to a current limiting network 107, the positive voltage supply terminal of the amplifier 103, and the point $V_{supp}$, respectively. The point $V_{supp}$ is connected to the battery terminal Bat of the hearing aid via a switch 5, and the other end of the voltage drop network 102 connected to the non-inverting input 104 of the amplifier 103. The output of the amplifier 103 is connected to an output impedance matching network 108 which in turn is connected to the output terminal Out. A feedback loop network 106 for controlling the gain is connected between the output and the inverting input 105 of the amplifier 103.

The signal to be inverted by the inverter stage 100 is taken from the input terminal In and presented to the inverting input 105 of the amplifier 103 via the input impedance matching network 101. The signal is then amplified by the amplifier 103 and presented at the output terminal Out through the output impedance matching network 108. The amplification gain factor is chosen to be 1, equivalent to 0 dB, so as to achieve the option of switching the inverter stage 100 without affecting net gain. The gain is determined by selection of the parameters of the feedback loop network 106, and the voltage drop network 102 is used to determine the operating point of the amplifier 103, preferably so as to allow the voltage swinging about half the supply voltage. This latter feature maximizes the distortion-free output from the inverter stage 100. The current limiter 107 is used to limit the current drawn by the inverter stage 100, as the overall current consumption should be kept as low as possible to prolong battery life.

The switch 5 may selectively connect the point $V_{supp}$ to the battery terminal Bat of the hearing aid or to ground. Connecting the point $V_{supp}$ to the battery terminal Bat enables the inverter mode by supplying the amplifier 103 with power from the hearing aid battery. Connecting $V_{supp}$ to ground suppresses the inverter function by and allows the signal to pass straight from In through the input impedance matching network 101, the feedback loop network 106, and the output impedance matching network 108 to Out, thus making no change in the phase of the signal. Net gain is not affected by operating the switch 5. The inverter stage 100 may preferably be manufactured as part of an integrated silicon chip accommodating other parts of the hearing aid circuitry as well, and the switch 5 may preferably be controlled by the software used for programming the hearing aid, thus making it possible to activate or deactivate signal inversion during programming of the hearing aid.

Figure 5:
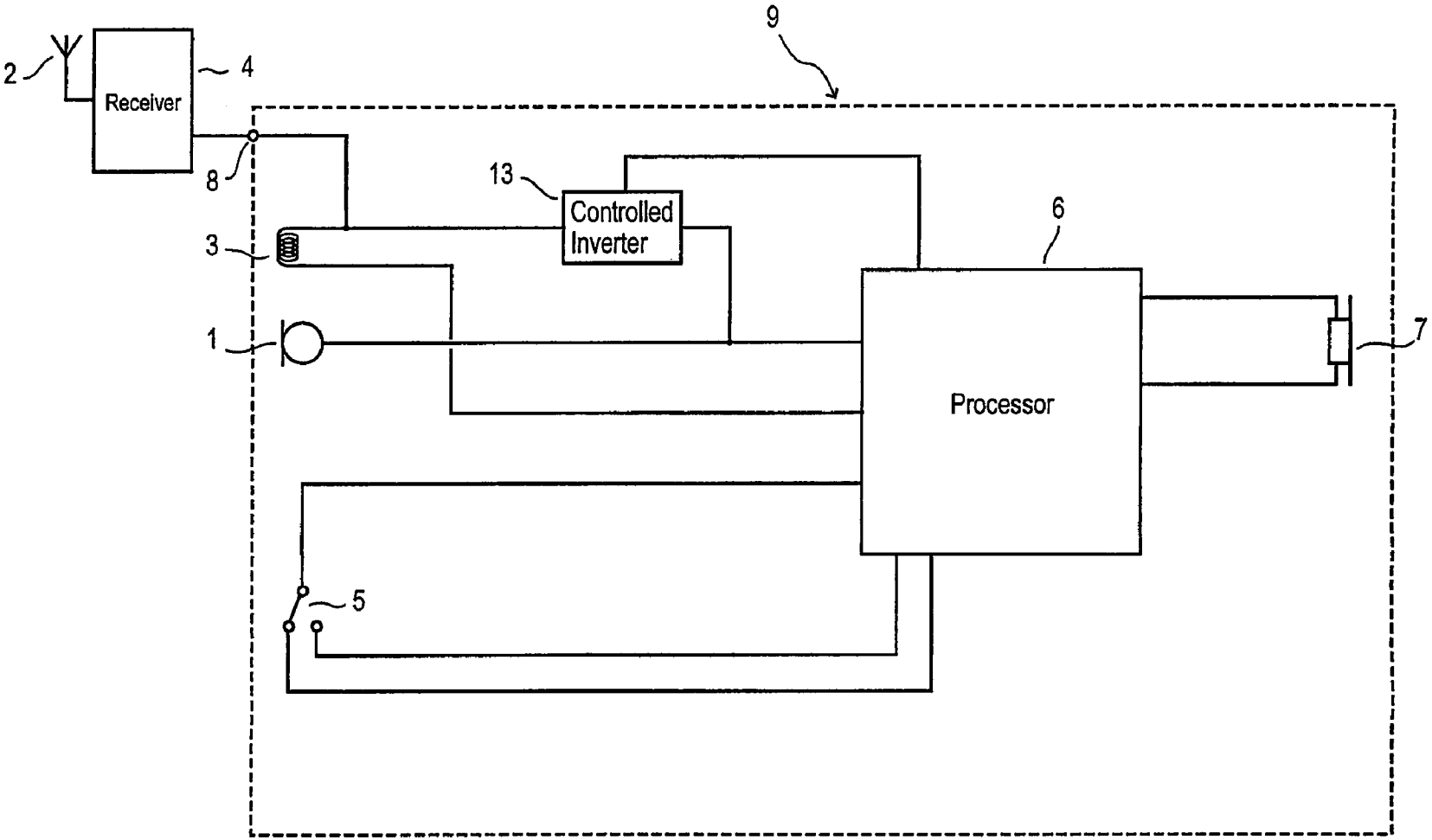
FIG. 5 is a block schematic of the hearing aid according to the invention.

FIG. 5 shows a hearing aid 9 comprising a microphone 1, a telecoil 3, a switch 5, a processor 6 and a hearing aid receiver 7. A wireless, electronic receiver 4 comprising a receiving antenna 2 is connected to the hearing aid 9 via a connection terminal 8. Both the receiver 4 and the telecoil 3 are connected to a controlled inverter stage 13 of the kind shown in FIG. 4. The telecoil 3 is disconnected from the hearing aid circuit whenever the receiver 4 is connected and active. Means for disconnecting the telecoil 3 have not been illustrated, as they will be obvious to those skilled in the art.

The controlled inverter stage 13 feeds an output to the processor 6, which also provides the control of the inverter function. This makes it possible to invert the signals from the telecoil 3 or receiver 4 at will by providing the processor 6 with adequate control signals. In the embodiment in FIG. 5, it is not possible to invert the signal from the microphone 1. A modification of the circuit to incorporate this feature in the signal path should, however, be obvious to a person skilled in the art.

The processor 6, in a further embodiment, comprises means (not shown) for analysing and detecting the presence of speech and noise in the input signal and activating the controlled inverter 13 if the detected noise level exceeds a predetermined limit when compared to the detected speech level. The controlled inverter 13 may then be controlled dynamically by the processor 6, preferably utilizing some kind of hysteresis, depending on the presence of speech and noise in the signals and a predefined noise limit.

Figure 6:
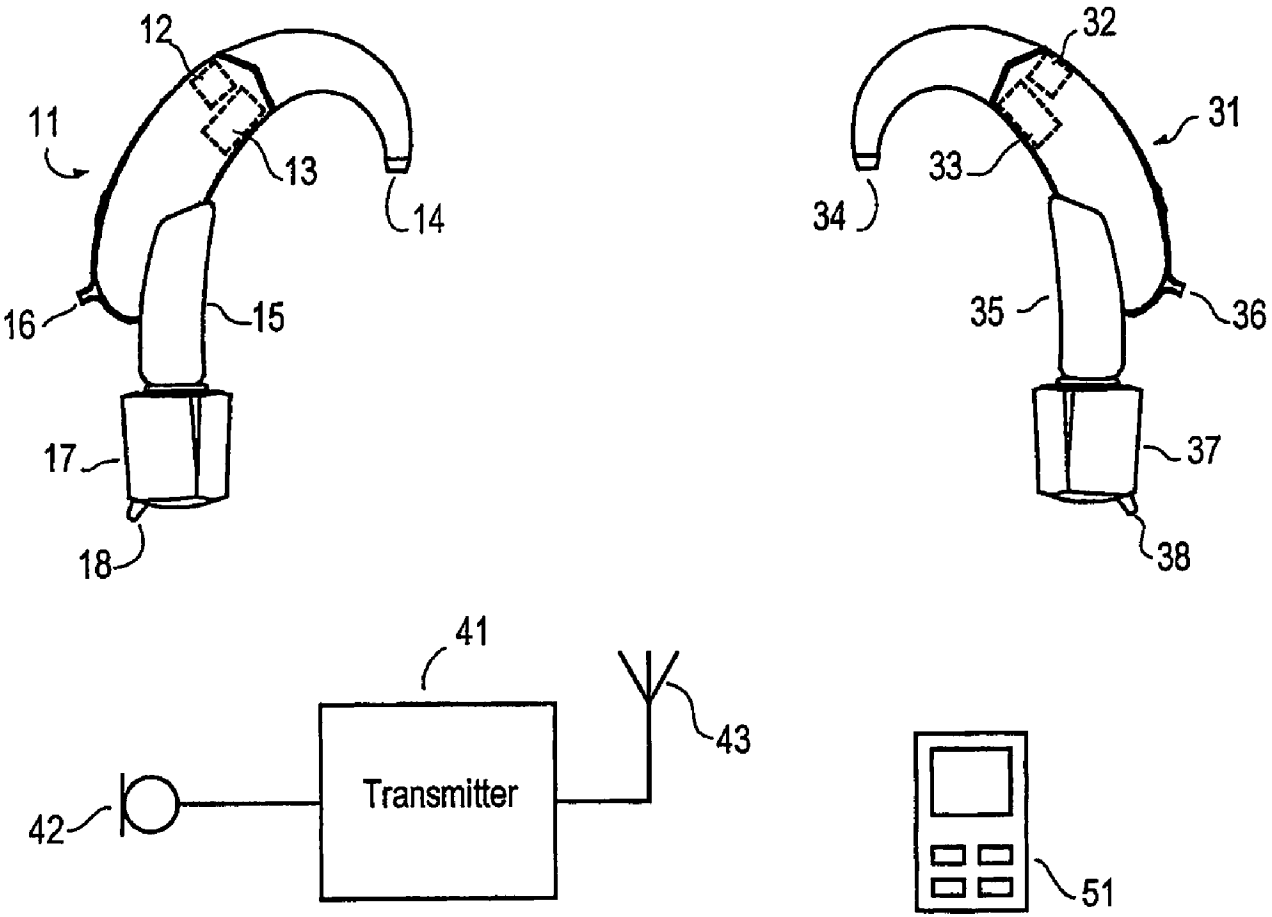
FIG. 6 is an overview of a composite hearing aid system, comprising two hearing aids and a transmitter.

FIG. 6 shows two hearing aids 11, 31, comprising microphones 12, 32 and hearing aid receivers 13, 33. The hearing aids 11, 31 are connected to respective electronic wireless receivers 17, 37, comprising switching means 18, 38, and adapters 15, 35. A wireless transmitter 41 with microphone 42 and antenna 43 is adapted to transmit signals to be received by the electronic wireless receivers 17, 37.

Acoustic signals picked up by the microphone 42 are converted into electronic signals by means of the wireless electronic transmitter 41 and transmitted by the antenna 43. The electronic wireless receivers 17, 37 pick up the transmitted signal and convert it into a signal suitable for reproduction by the hearing aid receivers 13, 33 in the respective hearing aids 11, 31. The hearing aids 11, 31 have means (not shown) for selectively inverting the phase of the signal from the wireless electronic receivers 17, 37, and these means may be enabled in just one of the hearing aids, 11, or 31, to provide a release from masking according to the invention in the way discussed previously.

The means for inverting the phase of the signal from the wireless electronic receivers 17, 37 may be implemented in other ways according to the invention. Means for detecting the presence of both speech and noise may be integrated in the signal processor of the hearing aids 11, 31, thus letting the signal processor decide whether it is beneficial to use phase inversion in one of the hearing aids, 11, or 31, or not. This feature requires an additional step in the fitting of the composite system to the user, i.e. deciding which one of the two hearing aids 11, 31 should be fed the phase-inverted signal from its respective electronic receiver 17, 37 to gain the benefits of a release from masking.

In one embodiment, the means for enabling the inversion of the phase of the signal from the electronic receivers 17, 37 is built into a remote control 51. The remote control 51 may be of the kind used for changing between different listening programmes in the hearing aids 11, 31, further equipped with means for controlling the phase inversion.

With respect to the foregoing it is important to emphasize that the benefit of a release from masking by means of the invention is maximized by using two substantially identical, but individually fitted, hearing aids, where one of the two hearing aids is adapted to permit a reversal of the polarity of the signal from the electronic receiver as previously explained.

We claim:

1. A hearing aid system comprising:

a first hearing aid having a first microphone, a first acoustic output transducer, a first electronic receiver and a first processor, said first processor being adapted to process an output signal from the first microphone and an audio output signal from the first electronic receiver in order to output through the first output transducer an acoustic signal for a user's right ear, a second hearing aid having a second microphone, a second acoustic output transducer, a second electronic receiver and a second processor, said second processor being adapted to process an output signal from the second microphone and an audio output signal from the second electronic receiver in order to output through the second output transducer an acoustic signal for a user's left ear, an electronic transmitter system adapted to transmit an audio signal for being simultaneously received by said first and second electronic receivers, and means for selectively inverting the polarity of the audio signal of one of the first or second electronic receivers as compared to the polarity of the audio signal of the other one of the first or second electronic receivers.

2. The system according to claim 1, comprising means for automatic activation of the means for inverting the polarity of the output signal of one of the electronic receivers.

3. The system according to claim 1, comprising switching means for manual activation of the means for inverting the polarity of the output signal of one of the electronic receivers.

4. The system according to claim 1, comprising a remote control adapted for communicating with at least one of the hearing aids for activating said means for inverting the polarity of the output signal of the respective electronic receiver.

5. The system according to claim 1, comprising a remote control adapted for communicating with at least one of the electronic receivers for activating said means for inverting the polarity of the output signal of the respective electronic receiver.

6. The hearing aid system according to claim 1, wherein said means for inverting the phase of the output signal of one of the electronic receivers is located in the respective electronic receiver.

7. A hearing aid system comprising:

a first hearing aid having a first microphone, a first acoustic output transducer, a first electronic receiver and a first processor, said first processor being adapted to process an output signal from the first microphone and an audio output signal from the first electronic receiver in order to output through the first output transducer an acoustic signal for a user's right ear, a second hearing aid having a second microphone, a second acoustic output transducer, a second electronic receiver and a second processor, said second processor being adapted to process an output signal from the second microphone and an audio output signal from the second electronic receiver in order to output through the second output transducer an acoustic signal for a user's left ear, an electronic transmitter system adapted to transmit an audio signal for being simultaneously received by said first and second electronic receivers, means for selectively inverting the polarity of the audio signal of one of the first or second electronic receivers as compared to the polarity of the audio signal of the other one of the first or second electronic receivers and an adapter for connecting the respective electronic receiver to the hearing aid, wherein said means for inverting the phase of the output signal of one of the electronic receivers is located in said adapter.

8. The hearing aid system according to claim 1, wherein said means for inverting the phase of the output signal of one of the electronic receivers is located in the respective hearing aid.

9. The hearing aid system according to claim 1, wherein the electronic receivers are adapted to receive radio signals.

10. A hearing aid comprising a microphone, an acoustic output transducer, a processor, and means for interfacing with an electronic receiver, said processor being adapted to process an output signal from the microphone and an audio output signal from the electronic receiver, said means for interfacing with the electronic receiver having means for inverting the phase of the output signal from the electronic receiver in relation to a second output signal from a second hearing aid, wherein the output signal and the second output signal are simultaneously transmitted.

11. The hearing aid according to claim 10, comprising means for analysing and detecting the presence of speech and noise in the input signal and means for activating inversion of the phase in the electronic receiver if the detected noise level fulfils a set of predetermined criteria.

12. The hearing aid according to claim 10, comprising means for analysing and detecting the presence of speech and noise in the input signal and means for activating inversion of the phase in the electronic receiver if the detected noise level exceeds a predetermined limit when compared to the detected speech level.

13. The hearing aid according to claim 10, comprising means for selectively enabling or disabling said means for activating inversion of the phase in the electronic receiver.

14. A method for processing an audio signal derived from a pair of audio sources associated with a pair of hearing aids, comprising inverting the phase of the output signal of one of the audio sources as compared to the phase of the output signal of the other one of the audio sources further comprising providing a plurality of paired audio sources associated with the pair of hearing aids, selecting for a first audio source pair the one among the audio source pairs with the highest signal-to-noise ratio, and inverting the phase of the output signal for one of the audio sources within said first pair of audio sources.

15. The method according to claim 14, comprising reproducing a signal picked up by a plurality of independent microphones, and inverting the phase of one of the audio sources with respect to the phase of the other one of the audio sources.

* * * * *